United States Patent [19]

Kranz

[11] Patent Number: 5,065,957

[45] Date of Patent: Nov. 19, 1991

[54] DEVICE FOR CONTROLLING AERODYNAMIC BODIES

[75] Inventor: Walter Kranz, Taufkirchen, Fed. Rep. of Germany

[73] Assignee: Messerschmitt-Bölkow-Blohm GmbH, Munich, Fed. Rep. of Germany

[21] Appl. No.: 516,516

[22] Filed: Apr. 30, 1990

Related U.S. Application Data

[63] Continuation of Ser. No. 16,881, Feb. 20, 1987, Pat. No. 4,927,096.

[30] Foreign Application Priority Data

Feb. 27, 1986 [DE] Fed. Rep. of Germany ..... 3606423

[51] Int. Cl.[5] ..... F42B 13/28

[52] U.S. Cl. ..... 244/3.21

[58] Field of Search ..... 244/3.21, 3.22, 3.1; 102/208

[56] References Cited

U.S. PATENT DOCUMENTS

| | | | |
|---|---|---|---|
| 4,512,537 | 4/1985 | Sebestyen et al. | 244/3.21 |
| 4,681,283 | 7/1987 | Kranz | 244/3.22 |
| 4,898,342 | 2/1990 | Kranz et al. | 244/3.21 |
| 4,966,078 | 10/1990 | Schleimann-Jensen | 244/3.21 X |

*Primary Examiner*—Mark Hellner

*Attorney, Agent, or Firm*—Kenyon & Kenyon

[57] ABSTRACT

A device for controlling an aerodynamic body having a searching head, a sensor and setting members for exerting a transversal force on the aerodynamic body into a target due to the sensor signals. In order to make possible a simple design of this device which can also be used for small aerodynamic bodies, the sensor and the setting members are arranged at a common rotor which rotates, driven about the longitudinal axis of the aerodynamic body, and can be influenced by means of a braking system as to its angular position relative to the aerodynamic body, generating a transversal force on the aerodynamic body.

18 Claims, 2 Drawing Sheets

FIG. 1
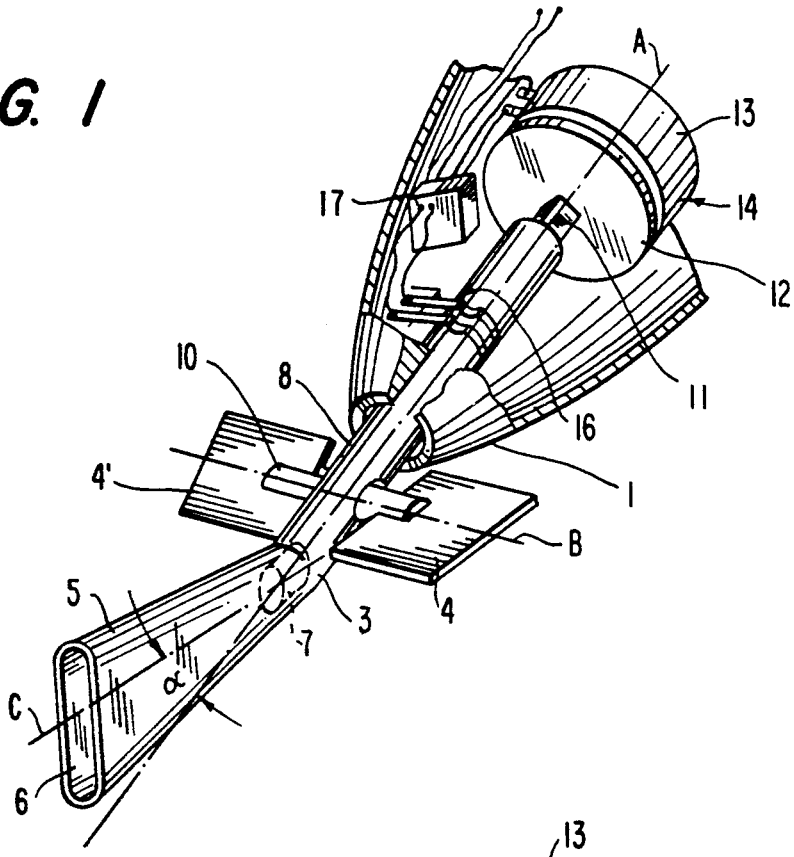
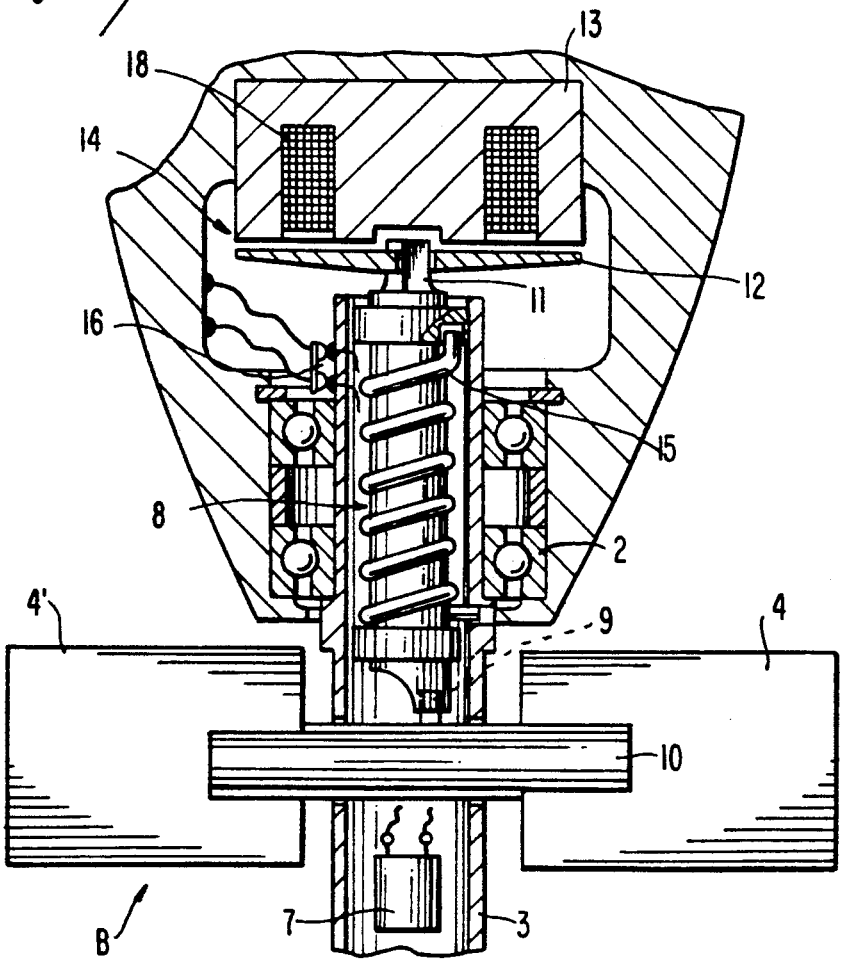
FIG. 2

DEVICE FOR CONTROLLING AERODYNAMIC BODIES

CONTINUING DATA

The present application is a continuation of U.S. application Ser. No. 016,881, filed Feb. 20, 1987, now U.S. Pat. No. 4,927,096 entitled ROTOR SETTING SYSTEM IN CONJUNCTION WITH AERODYNAMIC BODY CONTROLS, and assigned to the assignee of the present application.

BACKGROUND OF THE INVENTION

Searching head controls for aerodynamic bodies are known. There, it is necessary to coordinate the prevailing scanning direction of the sensor with the effective direction of the setting members when a target is picked up so that a trajectory correction in the direction toward the target is assured.

SUMMARY OF THE INVENTION

It is an object of the present invention to describe a device of the type under discussion which is of simple design, has small dimensions and with which the coordination between the scanning direction and the effective direction of the setting members is particularly simple.

The above and other objects of the present invention are achieved by a device for controlling an aerodynamic body having a searching head, a sensor for scanning a ring-shaped scanning area and a setting member for exerting a transversal force on the aerodynamic body responsive to a signal from the sensor, the sensor being disposed in a rotor which is coaxial with the longitudinal axis of the aerodynamic body and driven in a rotating mode, the rotor including said setting member for exerting the transversal force on the aerodynamic body in a plane containing the sensor axis and the longitudinal axis of the aerodynamic body, and further comprising a setting device for adjusting the angular position of the rotor relative to the aerodynamic body.

Accordingly, the searching head and the setting member or members are located in a common rotor which rotates about the longitudinal axis of the aerodynamic body. This makes a compact design possible. In addition, coordination between the scanning direction of the searching head and the effective direction of the setting member or members is particularly simple.

The device can also serve for controlling relatively small aerodynamic bodies, since the rotor can be designed with low inertia. For controlling slower and larger aerodynamic bodies, for instance, free-fall bombs, effective devices with inertia can be described.

The setting member may be, for instance, adjustable rudders supported at the rotor on both sides of the longitudinal axis of the aerodynamic body or rigid rudders arranged at the rotor outside the longitudinal axis of the aerodynamic body where the rotor is set in rotation in both designs by the on-flow against the rudders. If a transversal force is to be exerted on the aerodynamic body, the rotor is braked or stopped so that the effective direction of the transversal force coincides with the scanning direction of the sensor.

BRIEF DESCRIPTION OF THE DRAWINGS

The invention will be described in greater detail in the following detailed description with reference to the drawings, in which:

FIG. 1 shows a perspective view, partly in cross section, of the tip of an aerodynamic body with a searching head control according to the invention, where a sensor of the searching head and setting member is arranged on a common rotor;

FIG. 2 shows a longitudinal section through the aerodynamic body according to FIG. 1 in a part of the tip.

DETAILED DESCRIPTION

Figure 3:
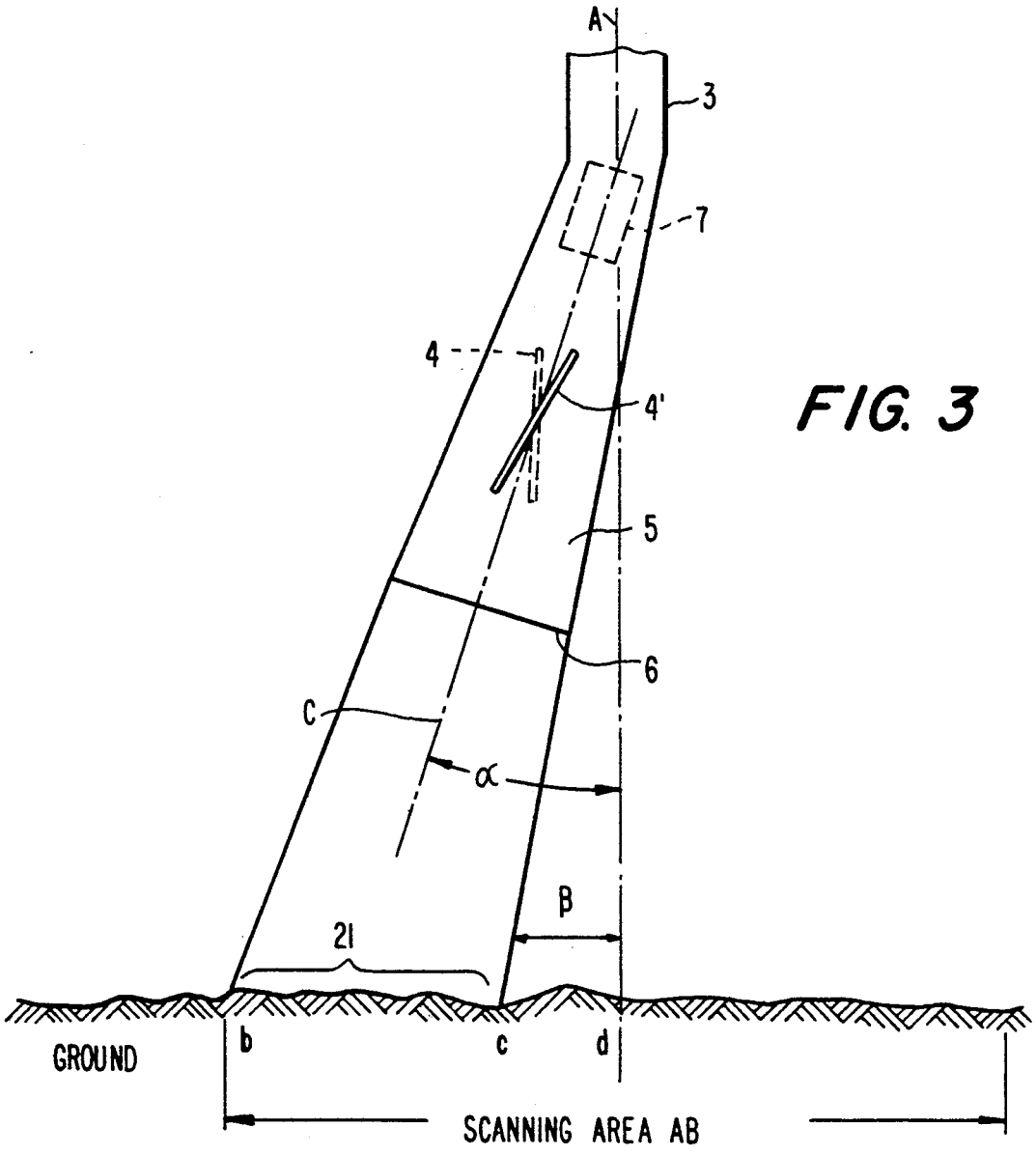
FIG. 3 is a schematic presentation of the principle for a searching head with a modified arrangement of the setting members.

In FIG. 1, part of a tip of an aerodynamic body 1 is shown, in this case, a relatively slow free-fall rocket with the longitudinal axis (A). By means of a bearing 2 (FIG. 2), a rotor 3 is located in the aerodynamic body 1 which is coaxial with the longitudinal axis (A) of the aerodynamic body 1 and carries outside the aerodynamic body a crossed pair of rudders 4 consisting of two rudders adjustable about an axis B disposed transversely to the longitudinal axis A of the aerodynamic body. The hollow rotor 3 is bent off beyond the rudders 4 in the form of a funnel 5 with a slot-shaped opening 6, where the central axis C of the funnel is set against the longitudinal axis A of the aerodynamic body by an angle $\alpha$. At the narrow end of the funnel, at the transition to the hollow rotor, an acoustical sensor 7 is disposed. The funnel with the sensor could be called an acoustic tube. Within the hollow rotor, a control shaft 8 is located which carries a pin 9 at its outer end, which engages a shaft 10 connecting the crossed rudders 4. At its other end inside the aerodynamic body, the control shaft 8 is connected to a post 11 which carries a braking disc 12 of magnetic material. An electromagnet 13 is associated with this braking disc. The electromagnet 13 and the braking disc 12 form a braking system 14. The control shaft 8 is surrounded by a coil spring 15 which is hung at the control shaft 8 in the region of the braking disc, and into the rotor 3 in the region of the pin 9.

In the interior of the aerodynamic body further slide two sliders 16 on corresponding contact rings of the rotor, whereby the sensor signal is passed to a signal processor 17 with gain and further, to coils 18 of the electromagnet 13.

If the braking system 14 is not activated, the rotor 3 is kept in rotation continuously by the crossed rudders 4. If a transversal force is to be exerted on the aerodynamic body, the braking system 14 is activated so that the control shaft 8 is braked relative to the rotor 3 and in the process, the crossed rudders 4 are rotated via the pin 9 engaging the shaft 10 of the rudders.

According to FIG. 2, the two crossed rudders 4 can be adjusted together. It is, of course, possible to arrange one rudder fixed and to cross only the second rudder. A further arrangement of the rudders is shown in FIG. 3. The rudders 4' are arranged fixed with the rotor 3 in the region of the funnel 5. If the braking system is not activated, the rotor turns freely due to the crossed fixed pair of blades 4'. If the rotor 3 is arrested, a transversal force is generated on the aerodynamic body due to the off-center arrangement of the rudders relative to the longitudinal axis A of the aerodynamic body.

The operation of the device for controlling the aerodynamic body by means of the sensor signals will be explained in greater detail in connection with FIG. 3. The following conditions are of importance for the operation:

The aerodynamic body rotates about its longitudinal axis A, while the rotor 3 rotates in a direction opposed to the direction of rotation of the aerodynamic body due to the crossed blades.

Through the rotation of the rotor 3, the sensor 7 scans the ground region 21, drawn in bold lines in FIG. 3 with rotational symmetry, the ground region being defined by the extended generatrix lines of the funnel 5, while the points of impingment on the ground are designated with b and c and accordingly, the annular ground area is located between two cones with generatrix lines corresponding to the outer and inner generatrix lines of the funnel 5. The maximum scanning range is designated with AB in FIG. 3.

As long as no target is picked up by the sensor 7, the rotor 3 rotates freely, unimpeded by the braking system 14, due to the crossed pair of blades 4 or 4'. The scanning area AB is decreased with decreasing distance between the aerodynamic body and the ground.

In the case of a fixed crossed pair of rudders 4' arranged in the region of the funnel 5 according to FIG. 3, a transversal force is exerted on the aerodynamic body in every angular position of the rotor; its action, however, is cancelled by the continuous rotation at least to the extent that the aerodynamic body 1 keeps the direction of flight in the average.

In the case of a rudder arrangement according to FIGS. 1 and 2, no transversal forces are effective on the aerodynamic body 1 in any angular position of the rotor 3. Thereby, the aerodynamic resistance is reduced from that of the embodiment according to FIG. 3. Likewise, the control of the transversal force is simplified, although at the expense of the increased costs for the adjustment of the rudder 4.

If a target giving off noise is located within the scanning range AB on the annular area 21, the sensor 7 picks up these noises and immediately initiates braking of the rotor 3 by addressing the braking system 14. With complete braking or also already with reduced braking, the rotor 3 co-rotates with the aerodynamic body, i.e., opposed to the original direction of rotation of the rotor and also opposed to the target in space, since the aerodynamic body itself rotates relative to the environment. Thereby, the picked up target is soon outside the pickup range of the sensor, so that the latter will no longer pick up the acoustic signal of the target. At this instant, the brake is disengaged and the rotor again rotates in the original direction of rotation predetermined by the crossed pair of rudders, until the acoustic signal is picked up again. At this instant, the brake is switched on again. This process is repeated continuously. In the average the rotor is located fixed in space with its axis C in the direction of the target, i.e., the pair of blades 4 or 4', continuously generate a transversal force on the aerodynamic body in the direction of the target until the target is located within the cone angle $\beta$ between the longitudinal axis A of the aerodynamic body and the inner generatrix of the funnel 5. From then on, a zero command is given again, i.e., the braking system is no longer activated, so that the rotor again turns freely.

By the increasing reduction of the distance between the aerodynamic body and the target, the acoustic signal is received by the sensor again and again in the range between b and c' "from the inside (c', d)". As described above, a transversal force aimed correspondingly is then being built up, until ultimately the aerodynamic body lands in the target.

The inaccuracy of the control of the aerodynamic body is co-determined here by the angle $\beta$. The latter serves primarily for the purpose not to have to align every tumbling motion of the aerodynamic body. On the other hand, it can be expected that, for an angle of nearly zero, additional stabilization of the aerodynamic body can be achieved especially if the control by transversal forces is smaller than the maximum transversal forces, as applies to the embodiment according to FIGS. 1 and 2. There, a forced rotation of the pair of rudders 4 about the axis B takes place by a correspondingly increasing generation of transversal forces if the braking disc 12 exerts a force on the pin arranged off center, via the post 11 and the control shaft 8. In the case of more extended coupling of the rotor 3 with the aerodynamic body 1 via the braking disc 12, the pair of rudders 4 rotates about the axis B up to an angle limit which can be formed by a stop or by the provision that at this limit angle, the coil spring 15 is wound firmly about the control shaft 8. Then as a consequence, the pair of rudders 4 will rotate together with the control shaft in the opposite direction of rotation, according to the direction of rotation of the aerodynamic body. This means the possibility of generating a full command into a defined direction in space.

The described searching head-steering system can also be used for faster aerodynamic bodies, in which increased reaction capability of the entire control mechanism is required. This can be achieved, for instance, by low-inertia components and mechanical separation of the measuring system from the mechanism for exerting transversal forces.

In the foregoing specification, the invention has been described with reference to specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A device for controlling an aerodynamic body having a searching head, a sensor for scanning a first predetermined scanning area, a setting member for exerting a transversal force on the aerodynamic body responsive to a signal from the sensor, and a setting device for adjusting the angular position of a rotor relative to the aerodynamic body, with the transversal force being used to place an acquired target in a second predetermined area relative to the first predetermined scanning area, with the sensor being disposed in a rotor coaxial with the longitudinal axis of the aerodynamic body and being driven in a rotating mode, and with the rotor including the setting member for exerting the transversal force on the aerodynamic body in a plane containing the sensor axis and the longitudinal axis of the aerodynamic body if the sensor senses the target in the first predetermined area.

2. The device recited in claim 1, wherein the rotor has in a forward region a hollow part which is bent off from the longitudinal axis of the aerodynamic body and in which the sensor is supported.

3. The device recited in claim 2, wherein the hollow part comprises a funnel with a slot-shaped opening, the sensor being located in a region inside the rotor in which the longitudinal axis of the aerodynamic body and the sensor axis of the funnel intersect.

4. The device recited in claim 1, wherein the rotor protrudes from the tip of the aerodynamic body and is provided with crossed rudders for setting the rotor in rotation.

5. The device recited in claim 4, wherein the rudders comprise the setting member.

6. The device recited in claim 5, wherein the rudders are arranged at the rotor on both sides of the longitudinal axis of the aerodynamic body, and at least one of the rudders is adjustable.

7. The device recited in claim 5, wherein the rudders are designed as a fixed crossed pair of blades which is arranged at the rotor such that a transversal force is continuously exerted on the aerodynamic body.

8. The device recited in claim 1, wherein the setting device for adjusting the angular position of the rotor is an electromagnetic braking system comprising an electromagnet and a braking disc connected to the rotor.

9. The device recited in claim 1, wherein the aerodynamic body and the rotor rotate about the longitudinal axis of the aerodynamic body in mutually opposite directions of rotation as long as there are no sensor signals.

10. A device for controlling an aerodynamic body having a searching head, a sensor for scanning a first predetermined scanning area, a setting member for exerting a transversal force on the aerodynamic body responsive to a signal from the sensor, and a setting device for adjusting the angular position of a rotor relative to the aerodynamic body with the sensor being disposed in a rotor coaxial with the longitudinal axis of the aerodynamic body and being driven in a rotating mode, and with the rotor including the setting member for exerting the transversal force on the aerodynamic body in a plane containing the sensor axis and the longitudinal axis of the aerodynamic body and including a forward region having a hollow part which is bent off from the longitudinal axis of the aerodynamic body and in which the sensor is supported.

11. The device as recited in claim 10, wherein the hollow part comprises a funnel with a slot-shaped opening, the sensor being located in a region inside the rotor which the longitudinal axis of the aerodynamic body and the sensor axis of the funnel intersect.

12. The device recited in claim 11, wherein the rotor extends from the tip of aerodynamic body and is provided with crossed rudders for setting the rotor in rotation.

13. The device recited in claim 12, wherein the rudders comprise the setting member.

14. The device recited in claim 13, wherein the rudders are arranged at the rotor on both sides of the longitudinal axis of the aerodynamic body, and at least one of the rudders is adjustable.

15. The device recited in claim 13, wherein the rudders are designed as a fixed crossed pair of blades which is arranged at the rotor such that a transversal force is continuously exerted on the aerodynamic body.

16. The device recited in claim 11, wherein the setting device for adjusting the angular position of the rotor is an electromagnetic braking system that includes at least an electromagnet and a braking disc connected to the rotor.

17. The device recited in claim 11, wherein the aerodynamic body and the rotor rotate about the longitudinal axis of the aerodynamic body in opposite directions of rotation as long as predetermined signals are not output from the sensor.

18. A method of controlling an aerodynamic body, comprising the steps of:

(a) rotating a rotor coaxial with a longitudinal axis of the aerodynamic body and in a direction opposite to the direction of rotation of the aerodynamic body;

(b) scanning with a sensor a first predetermined area defined by an open end of the rotor and acquiring a target in the first predetermined area;

(c) braking the rotation of the rotor with respect to the rotation of the aerodynamic body and exerting a transversal force on the aerodynamic body, with the transversal force being used to place an acquired target in a second predetermined area relative to the first predetermined scanning area;

(d) rotating the rotor in a direction opposite that of the aerodynamic body when the target is outside the first predetermined area; and (e) repeating steps (a), (b), (c), and (d) until the aerodynamic body contacts the target.

* * * * *